United States Patent [19]

Gauthier et al.

[11] Patent Number: 4,847,574

[45] Date of Patent: Jul. 11, 1989

[54] WIDE BANDWIDTH MULTIBAND FEED SYSTEM WITH POLARIZATION DIVERSITY

[76] Inventors: Simon R. Gauthier, 23 Welby Court, Ottawa, Ontario, Canada, K1V 0H7; Kwok K. Chan, 26 Calais Circle, Kirkland, Quebec, Canada, H9H 3V3

[21] Appl. No.: 82,745

[22] Filed: Aug. 7, 1987

[30] Foreign Application Priority Data

Sep. 12, 1986 [CA] Canada ..... 518140

[51] Int. Cl.[4] ..... H01P 1/161

[52] U.S. Cl. ..... 33/21 A; 333/135; 333/110

[58] Field of Search ..... 333/117, 110, 122, 135, 333/21 A, 21 R, 134, 136, 137, 126, 129; 343/756

[56] References Cited

U.S. PATENT DOCUMENTS 3,731,236 5/1973 Di Tullio et al. ..... 333/126
3,838,362 9/1974 Kurtz ..... 333/135
4,233,576 11/1980 Pelchat ..... 333/21 A X
4,367,446 1/1983 Hall ..... 333/21 R
4,546,471 10/1985 Bui-Hai ..... 333/21 A X
4,680,558 7/1987 Ghosh et al. ..... 333/21 R

*Primary Examiner*—Eugene R. LaRoche
*Assistant Examiner*—Seung Ham
*Attorney, Agent, or Firm*—Stevens, Davis, Miller & Mosher

[57] ABSTRACT

A multiband feed system for a reflector antenna, capable of operating simultaneously at a plurality of separate bands of wide bandwidths and of having both frequency and polarization diversity, comprises a common tapered waveguide for carrying the frequency multiplexed bands and orthomode junctions spaced along the length of the waveguide for coupling signals in a single frequency band in and out of the waveguide. 90° and 180° narrowband polarization devices between the orthomode junctions and the orthomode transducers provide polarization diversity. A dual-depth corrugated flared horn operating in a beamwidth saturation mode with the feed system gives a radiation pattern with low cross-polarization content and nearly equalized subreflector illumination at all bands of operation.

13 Claims, 5 Drawing Sheets

WIDE BANDWIDTH MULTIBAND FEED SYSTEM WITH POLARIZATION DIVERSITY

FIELD OF THE INVENTION

The present invention relates generally to microwave systems and more particularly to a very wide band primary feed for dual-reflector antennas.

BACKGROUND OF THE INVENTION

The development of multi-payload communication satellites has given rise to a need for ground terminals with simultaneous frequency reuse capability at more than one frequency band. This, in turn, requires a feed system that is capable of operating in a plurality of different and widely separated bands. For satellite communication applications, the feed should preferably operate simultaneously at three separate receive bands with wide bandwidths; present satellite telecommunications systems generally downlink signals in the 3.40–4.20 GHz band (known as the C-band); the 7.25–7.75 GHz band (X-band); and the 10.7–12.2 GHz band (Ku-band). At each band, the polarization should be independently and remotely selectable, so that either horizontal and vertical linearly polarized signals or right-handed and left-handed circularly polarized signals can be received. The feed should also provide polarization isolation of better than 30.7 dB (equivalent to an axial ratio of 0.5 dB) between the orthogonal signals when installed on the host reflector antenna. The triband feed system must also exhibit a good match at the output ports, as well as low insertion loss.

Several techniques are currently available for implementing the multiband requirement. The simplest way to provide simultaneous multifrequency operation is to use three separate antennas. Such an approach has some advantages over any solution involving a single antenna; it provides the best electrical performance, because each feed is optimally designed for its own band and therefore has low insertion loss, and it enables a smaller antenna size to be used for an equivalent G/T performance. In addition, the design of the feed configuration is obviously much simpler. However, this method has the disadvantage of requiring the installation, operation and maintenance of three antennas, at a significantly higher cost than for a single antenna.

A second method of providing a multiband band involves the use of three separate movable feeds, one feed for each band, with a single reflector antenna. However, if three different feeds are positioned around the antenna focal point, then two of the secondary beams are squinted with respect to the main axis, leading to substantial loss in gain and cross-polarization isolation. In order to obtain zero beam squint, each feed must be moved into the focal position; such an arrangement seriously impairs the ability of the antenna to operate nearly simultaneously at the three different bands.

A third multibanding technique involves the use of a frequency selective subreflector in a dual reflector configuration, in order to separate one of the frequency bands; thus, for example, in the above triband system, the feed behind the subreflector could operate at the Ku-band while the feed at the focus would operate at both the C-band and the X-band. The subreflector would reflect the C-band and X-band with low loss, as if it were a metallic surface, and would act as a high pass filter for the Ku-band. This would separate the three bands into two groups, thereby somewhat simplifying the design problems of a multiplexed feed. However, implementation of this method requires a major modification to existing reflector antennas and is, as such, relatively complex and expensive. In addition, because of the strict dimensional constraints on the frequency selective subreflector, the subreflector must be used in a controlled environment (such as a radome) and is unsuitable for use with an unprotected antenna, where snow and ice on the surface of the subreflector might affect its proper operation. Also, fabrication of a shaped subreflector involves a series of precise and therefore expensive manufacturing steps. In addition, the resulting performance degradation at the Ku-band, because of the absence, due to the shaping process, of a distinct focal point therefore, is greater than with other methods.

Accordingly, it is seen that a multiplexed feed system has a number of advantages over the other methods previously used. Only a single antenna structure is required for operational coverage of all three frequency bands, and in modifying standard reflector antenna configurations or retrofitting existing stations, the reflector antenna surface need not be changed, only the feed being replaced.

Several different devices for transmitting multiplexed microwave signals are known to persons skilled in the art. In one such device, the zero-dB coupler, the signals are coupled from a center or main waveguide through four distributed series of longitudinal slots, each slot having two planes of symmetry, to a set of auxiliary rectangular waveguides. Each pair of diametrically opposed slots couples one polarization from the main guide. Opposite pairs of rectangular waveguides are fed into "Magic T" junctions, which in turn group the orthogonally polarized signals into a polarization combiner, wherein the signals can be rotated and/or converted to circular polarization. However, practical implementations of this configuration have high coupling losses, and so the zero-dB coupler is used mainly to provide tracking functions or communications in transmission bands where losses are not critical. The complexity of the device also leads to high manufacturing costs.

In another such device, a co-axial guide, a plurality of concentric guides are used to multiplex and separate the plurality of frequency bands. However, this device is inherently lossy, and the abrupt junctions therein generate higher order modes, degrading the cross-polarization performance.

Yet another means of multiplexing and propagating the signals makes use of a dielectric rod. To ensure that the high frequency signals (which is carried by means of a surface wave mode, rather than the waveguide mode of the lower frequencies) is bound closely to the surface, the relative propagation constant between surface wave and free space must be in a prescribed range. However, for signals in the frequencies of interest, the resulting diameter of the rod is such as to perturb the lower band (that is, the 4 and 7 GHz) signals. The dielectric rod is therefore more appropriate for use with the propagation of extremely high frequency signals, an application in which the diameter of the dielectric rod can be made suitably small.

In another technique, the polarization diplexing concept, the multiplexed signals are separated by polarization through a wideband orthomode junction; the horizontal polarized signal is coupled out through a side port while the vertically polarized signal propagates directly through, separation being achieved by means of metallic plates. Each of the signals is then divided into the plurality of bands by a multiplexer. Difficulties arise with the design of the wideband orthomode junction and multiplexer, as well as with amplitude and phase matching of the devices for the orthogonal paths. The use of polarization diplexing is thus usually limited to applications where the signals are restricted to two bands and linear polarization.

The branch filtering concept makes use of multiplexing the signals in the different band frequencies and then using junction devices, spaced along the common tapered waveguide which propagates the signals, to couple the signals of the different band frequencies in and out of the waveguide. This promising approach, subsequently developed for use with the present invention, was applied to the design of a dual frequency band antenna feed, as described in an article by I. Sato, S. Tamagawa, I. Mori, R. Kuzuya, and A. Abe entitled "Dual Frequency Band Antenna Feed Design", published in the Proceedings of the 1985 Europen Microwave Conference, held at Paris, at pp. 445–450 thereof.

A number of patents have been addressed to microwave signal processing and transmission. Canadian Pat. No. 1,190,317 discloses a primary source for a ground-based space communications antenna operating with utilization of the same frequency band in two orthogonal polarizations. In one embodiment, an orthomode junction coupled to a corrugated horn has extending therefrom two channels, an emission channel and a reception channel. The reception channel comprises a higher mode coupler, a 180° degree polarizer, a 90° polarizer, and on orthomode transducer whose polarization accesses are coupled to the reception accesses of the primary source through two rejection filters; the emission channel comprises an orthomode transducer coupled in series to a 90° polarizer and a 180° polarizer. In a second disclosed embodiment, the 90° polarizers are not placed in the emission and reception channels, but rather between the horn and the orthomode junction.

U.S. Pat. No. 3,978,434 discloses a system separating filter for separating two signals, each of which consists of a doubly polarized frequency band, the bands being of different frequency. The filter has three series connected doubly polarizable sections, the first waveguide section having an inner cross-section of such dimension that both frequency bands with their respective double polarizations can exist therein, the second waveguide section serving as a transition between the first and third waveguide sections, and the third waveguide section having an inner cross-section of such dimensions that at least the second frequency band with its double polarization can exist there. A pair of coupling means, each associated with a respective one of the two polarization directions, are provided for decoupling and passing the first frequency band while effecting a total reflection of the second frequency band. A polarization filter, connected to the third waveguide section in which only the second frequency band propagates, provides separate signals corresponding to the two polarizations of the second frequency band at its outputs.

U.S. Pat. No. 4,504,805 discloses a combiner for transmitting and receiving co-polarized microwave signals in a selected propagation mode in at least two different frequency bands. The combiner comprises a main waveguide dimensioned to simultaneously propagate signals in the different frequency bands, first and second junctions spaced along the length of the main waveguide for coupling the signals in and out of the main waveguide, and filtering means within the main waveguide for passing signals in the second frequency band past the first junction.

SUMMARY OF THE INVENTION

The present invention relates to a multiband feed system for a reflector antenna, capable of operating simultaneously at a plurality of separate bands of wide bandwidths and of having both frequency and polarization diversity, comprises a common tapered waveguide for carrying the frequency multiplexed bands and orthomode junctions spaced along the waveguide for coupling signals in a single frequency band in and out of the waveguide. 90° and 180° narrowband polarization devices between the orthomode junctions and the orthomode transducers provide polarization diversity. A dual-depth corrugated flared horn operating in a beamwidth saturation mode with the feed system gives a radiation pattern with low cross-polarization content and nearly equalized subreflector illumination at all bands of operation.

More particularly, the present invention relates to an antenna source system for receiving microwave signals in at least a first lower frequency band and a second higher frequency band, comprising: a waveguide dimensioned to simultaneously propagate signals in the first and the second frequency bands to a first orthomode junction, and having a stopband characteristic for signals in the first lower frequency band and a passband characteristic for passing signals in the second higher frequency band past the first orthomode junction; the first orthomode junction coupling signals in the first frequency band in and out of the waveguide and having a first access coupled to the waveguide and a second access; first filter means coupled to the second access of the first orthomode junction, and having a stopband characteristic for signals in the second higher frequency band and a passband characteristic for signals in the first lower frequency band; a second orthomode junction having a first access coupled to the first filter means and a second access; a first and second orthomode transducer each having a first access for receiving signals in one of the frequency bands and a second access which are respectively coupled to the waveguide past the first orthomode junction and to the second access of the second orthomode junction; a first 90° polarizing device and a first 180° polarizing device coupled in series between the first orthomode transducer and the waveguide; a second 90° polarizing device and a second 180° polarizing device coupled in series between the second orthomode transducer and the second orthomode junction; and a radiating element.

The present invention also relates to the above antenna source system, further comprising a third orthomode junction for coupling signals in a third frequency band, the third frequency band being between the first lower frequency band and the second higher frequency band, the third orthomode junction being located along the waveguide where the waveguide has a stopband characteristic for signals in the third frequency band and a passband characteristic for passing signals in the second higher frequency band past the third orthomode junction; the third orthomode junction coupling signals in the third frequency band in and out of the waveguide and having a first access coupled to the waveguide and a second access; second filter means coupled to the second access of the third orthomode junction and having a stopband characteristic for signals in the second frequency band and a passband characteristic for signals in the third frequency band; a fourth orthomode junction having a first access coupled to the filter means and a second access; a third orthomode transducer having a first access for receiving signals in the third frequency band and a second access which is coupled to the second access of the fourth orthomode junction; and a third 90° polarizing device and a third 180° polarizing device coupled in series between the third orthomode transducer and the fourth orthomode junction.

BRIEF DESCRIPTION OF THE DRAWINGS

A preferred embodiment of the present invention will now be described in conjunction with the attached drawings, in which.

DETAILED DESCRIPTION OF THE PREFERRED EMBODIMENT

Figure 1:
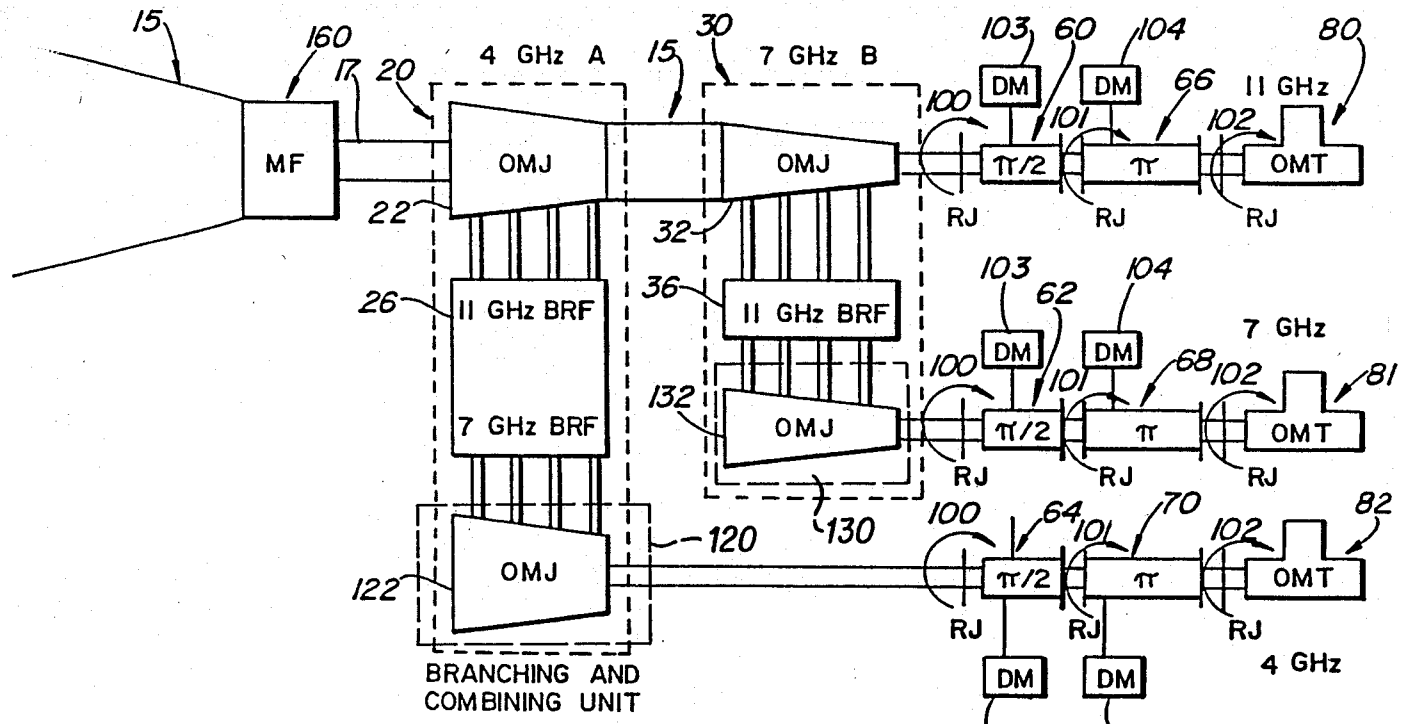
FIG. 1 is a block diagram of part of the triband multiplexed feed system of the present invention.
Figure 2:
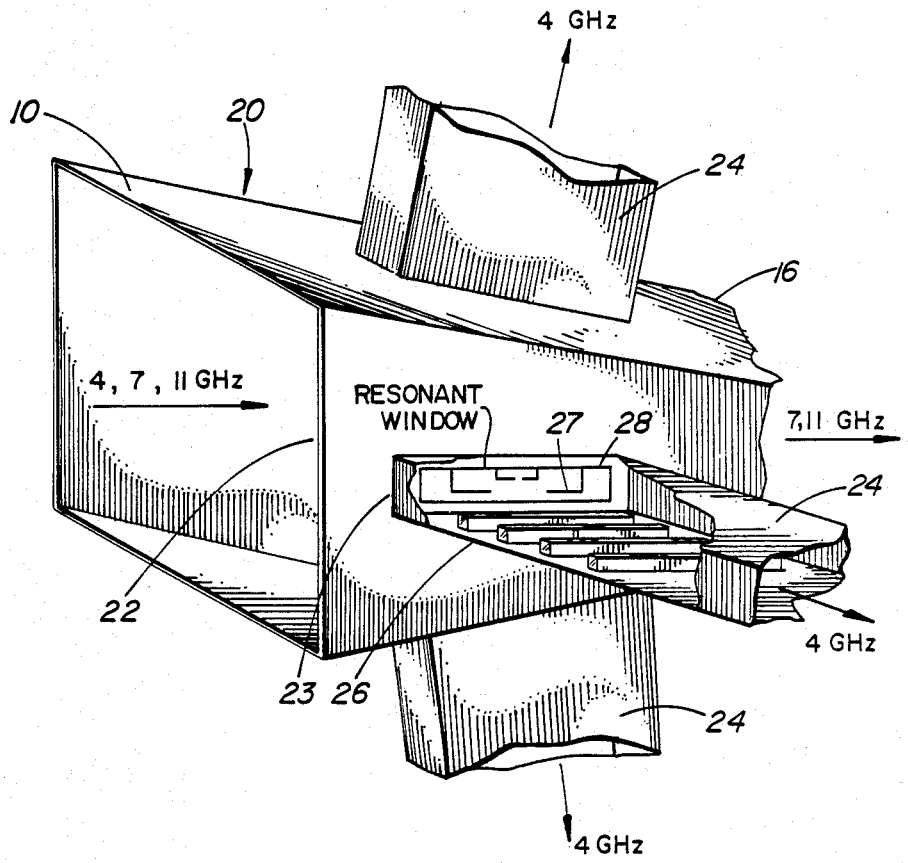
FIG. 2 depicts a partly cut-away view of a C-band branching unit element of FIG. 1.

As depicted in FIG. 1, a triband feed system 10 of the present invention comprises a common tapered waveguide 15 through which the frequency mutliplexed signals in the 4, 7 and 11 GHz bands are transmitted to and from the branching and combining units at junctions A and B along the length thereof. Waveguide 15 of illustrative system 10 has a tapered manifold of square cross-section between a mode filter 160 and junction B. Waveguide 15 has an aperture of side length equal to 1.55 inches at junction A. Longitudinally spaced along waveguide 15 is a 4 GHz branching unit, shown generally as 20 in FIGS. 1 and 2, for extracting the 4 GHz band signal from waveguide 15. Branching unit 20 comprises a six-port tapered orthomode junction 22, around the periphery of which are formed four symmetrical and identical longitudinal slots 23 to which side arms 24 (three of which are depicted in FIG. 2) are connected. As shown in FIG. 2 and depicted in the block diagrams of FIGS. 1 and 3, band reject filters 26 are inserted into each side arm 24, in order to provide port-to-port isolation for the different frequency bands. For the frequencies of interest, band reject filters 26 will, of course, have stopbands covering the 7 and 11 GHz bands. Waveguide 15 is suitably tapered so that end 16 thereof is below cut-off for the frequencies of the C-band, thereby enabling this portion of waveguide 15 to act as a high-pass filter.

Behind each slot 23 are two sets of dipole elements 27 and 28 which resonate at, respectively, the center frequencies of the 7 and 11 GHz bands; at resonance, elements 27 and 28 are approximately one-quarter wavelength long. Elements 27 and 28 essentially form a short circuit for the high frequency signals but allow the low frequencies to pass. About 10 dB of rejection is afforded by dipole elements 27 and 28, in addition to that provided by the common reflection plane for the higher bands.

In order to yield good VSWR characteristics, coupling slots 23 must be located at an optimum position along common guide 15, that is, where the strength of the longitudinal magnetic field is at a maximum. For a given flared contour shape of waveguide 15, this position occurs when the backward dominant wave, reflected by the cut-off plane of waveguide 15, is in-phase with the forward dominant wave. In addition, branching unit 20 must provide for the mimimum generation of higher order modes, which in turn requires a smooth and gradual contour shape for tapered waveguide 15. Furthermore, to suppress as many of the higher order modes as possible, all discontinuities should be symmetrical, so that only the symmetric modes are excited. The type of waveguide cross-section and its size must at the location at which the slots appear prevent, as far as possible, mode cut-off frequencies from appearing in any of the specified frequency bands. The longitudinal contour shape chosen for waveguide 15 therefore represents a trade-off between sideport match, throughport match and mode generation.

Considerations of mode suppression and impedence match indicate the use of a square cross-section for the branching units. For waveguide 15 having a 1.966 inch square cross-section at end 10, no modes have their cut-offs in the 4 and 7 GHz bands; the degenerate mode pair of $TE/TM_{32}$ cut in at 11.025 GHz, but the rest of the band is free of mode cut-offs. If the Ku-band specification is 10.9–11.7 GHz, then mode cut-off does not occur in any of the three bands.

Figure 3:
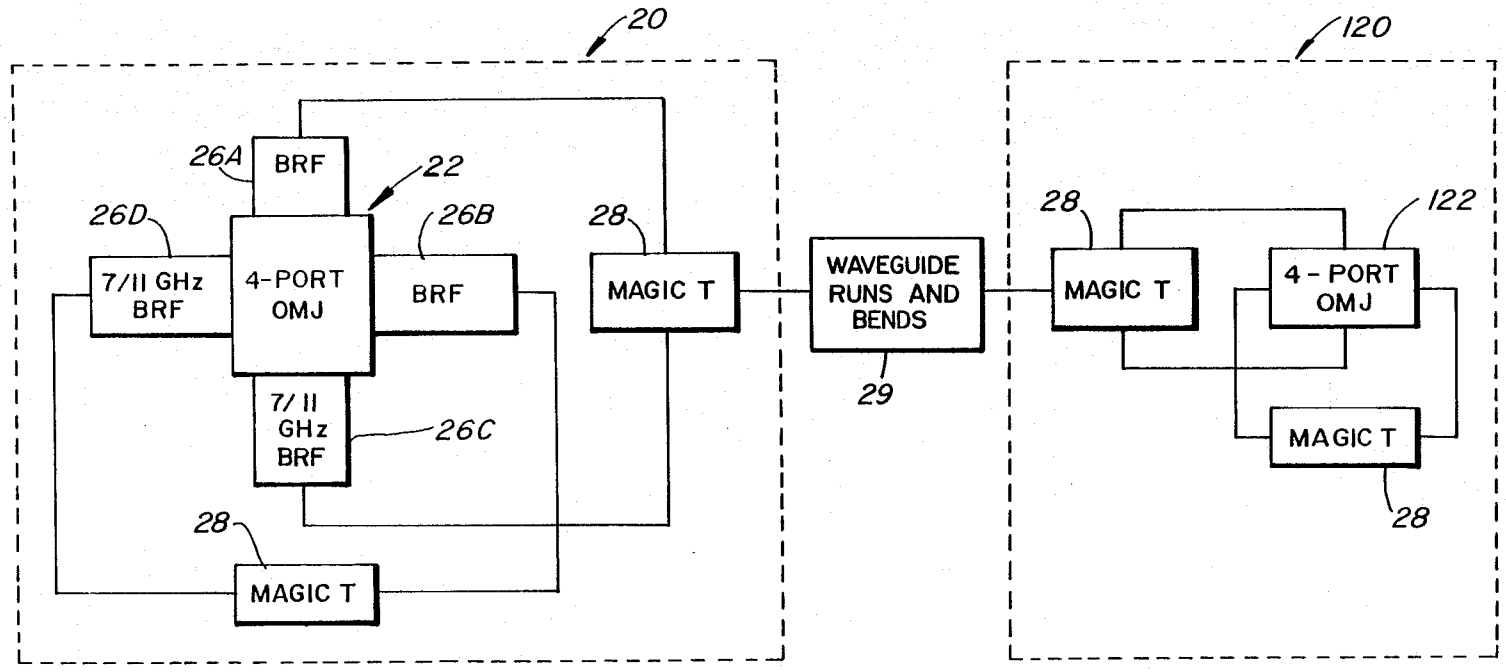
FIG. 3 is a more detailed block diagram of a C-band branching and combining unit of FIG. 1.

As illustrated in FIG. 2 and 3, band reject filters 26 are used with junction 22 of branching unit 20 to provide port-to-port isolation for the different frequency bands, as well as to prevent higher order mode excitation and VSWR degradation in the 7 and 11 GHz bands by coupling slots 23. A suitable type of filter for band reject filters 26 is the periodic E-plane corrugated waveguide filter. Such a filter can be designed using known procedures, such as the method of eigenmode matching and cascading of generalized scattering matrices. By using such a design procedure, a combined filter 26 having a total length of 1.300 inches was found suitable. The 7 GHz band reject filter has an input/output guide of 0.375 inches in height, an inner guide with reduced height of 0.210 inches, and corrugation pitches with slots of 0.415 inches in depth spaced 0.100 inches apart. The 11 GHz band reject filter has an input/output guide of 0.375 inches in height, an inner guide with reduced height of 0.255 inches, and corrugation pitches with slots of 0.265 inches in depth spaced 0.100 inches apart. With dipole elements 27 and 28 incorporated into longitudinal slot 23, only eight pitches in filter 26 are needed to give better than 50 dB of rejection. The H-plane dimension of the filter is set at 2.275 inches to prevent the excitation of the next higher order $TE_{30}$ mode at 7 GHz. The weakly (if at all) excited $TE_{30}$ mode in the 11 GHz band is stopped by the 7 GHz band reject filter.

It is important for satisfactory VSWR characteristics in the 7 and 11 GHz band that the equivalent short circuit reference plane created by band-reject corrugated filters 26 be located as close as possible to the wall of coupling slot 23. For this reason, the short length of the chosen filter type is ideal. Matching with slot 23 can then be effected at both the front and back of the filter.

A 7 GHz branching and combining unit 30 which follows 4 GHz branching unit 20 has the same design and working principle as branching unit 20. Since the cross-section of tapered waveguide 15, being 0.955 inches square, is at that point, below the cut-off frequency for the 4 GHz signal, only 11 GHz band reject filters 36 need to be provided with orthomode junction 32. The longitudinal separation along waveguide 15 between 4 GHz junction 20 and 7 GHz junction 30 is chosen such that the largest higher-order mode generated, as well as reflections in the principal mode for the 7 and 11 GHz bands, cancels.

Band reject filters 36 for branching unit 30 can be similar to those described above for branching unit 20.

After the 7 GHz signal is extracted by branching unit 30, only the 11 GHz band signals remain. Behind 7 GHz branching unit 30, the manifold of waveguide 15 is changed from one having a tapered square cross-section to a circular one with a diameter of 0.730 inches. In-line polarizers 60 and 66 (which are, respectively, 90° and 180°°polarizers) and an orthomode transducer 80 for the Ku-band signals are joined to this part of waveguide 15. Rotary joint 100 rotates polarizer 60, to permit either linear of circular polarization; rotary joint 101 allows adjustment of polarizer 66 to optimize the axial ratio of the antenna. Drive mechanism 103 and 104 effect the rotation of, respectively, joints 100 and 101. Rotary joint 102, for rotating orthomode transducer 80, is used if polarizer 66 is not present; rotation of transducer 80 enables a detector (not shown) to be tuned for its best reception, by effecting a slight relative displacement of the electric field. For 11 GHz band signals, the majority of the mode conversion is to the $TE_{12}/TM_{12}$ mode pair, because these are the lowest of the symmetric higher order modes. By spacing branching units 20 and 30 appropriately, cancellation of the higher order modes excited at each junction would occur, since these modes propagate with different phase velocities from that of the fundamental mode.

For the 4 and 7 GHz band signals, the configuration illustrated in FIGS. 1 and 3 can be employed to couple the band signals to the polarizers. Coupling unit 120 and 130, for, respectively, the 4 and 7 GHz band signals, comprise orthomode junction 122 and 132 which are identical to orthomode junctions 22 and 32 except for the absence of band reject filters. Orthomode junctions 22 and 122, and 32 and 132, are joined by hybrid T junction elements 28, often called "magic T's". As shown in FIG. 3, the same waveguide runs and bends allow the phases and amplitudes of the signals from "magic T's"28 to be made identical, thereby tuning the unit by eliminating imbalances of the reflections which occur because of imperfect matching. Coupling units 120 and 130 are used to couple the signals to 90° polarizer units 62 and 64 respectively. This technique has the advantage of inherent symmetry and enables the polarizers to be narrow banded.

To generate circular polarization, a linearly polarized wave is launched into a guide and inclined at 45° to the plane of the reactance by means of an orthomode junction. The wave can be resolved into two components, one parallel and the other perpendicular to the plane of reactance. The parallel component of the wave experiences a phase delay, while the perpendicular component undergoes a phase advance. If the relative phase difference between these two components is exactly 90°, a perfectly circularly polarized wave results.

90° polarizer units 60, 62 and 64 function in the circularly polarized mode of operation, while 180° polarizers 66, 68 and 70 function in the linearly polarized mode. Polarizers 60, 62 and 64 change the polarization state from circular to linear for reception. When operating in the circularly polarized mode, the phase shift planes of polarizers 62 and 64 are inclined at 45° to either side-arm port of the orthomode junction 122 or 132; the phase shift planes of 180° polarizers 68 or 70 are aligned parallel to one port. Polarizers 68 and 70 physically rotate the orientation of the linearly polarized waves to align the waves with the ports of orthomode junctions 122 and 132 and to maintain high polarization isolation. When operating, their phase shift plane may have any orientation with respect to the ports of orthomode junctions 122 and 132, depending on the polarization orientation of the incident signals; the phase shift planes of polarizers 62 and 64, on the other hand, must be aligned parallel to one of the ports since they are not operating. Polarizers 68 and 70 can be omitted if, instead, it is desired to rotate orthomode junction 122 or 132 and respective 90° polarizer 62 or 64 together; flexible waveguides must then be attached to the ports to allow movement. In the same manner as that for the processing of the 11 GHz band signals, described above, all the required rotations are effected by rotary joints 100 and 101 and drive mechanisms 103 and 104, which may be remotely controlled; similarly, rotary joints 102 can be used to rotate transducers 81 or 82 if the 180° polarizers are not used.

For the 7 and 11 GHz polarizers, dominant mode circular waveguide polarizers are an appropriate choice, giving 0.1 dB and 0.2 dB axial ratios, respectively. The corresponding waveguide diameters are 1.15 inches and 0.730 inches. In the 4 GHz band, however, the dominant mode circular polarizer of 2.125 inch diameter can provide at best 0.32 dB axial ratio. To reduce the axial ratio to 0.14 dB, the waveguide size can be increased to 2.70 inch diameter, but in doing so, the $TM_{01}$ mode might be excited and dimensional tolerance must be held to within $\pm 0.002$ inches to minimize these excitations. An alternative is to use a dominant model 1.965 inch square guide to achieve 0.33 dB axial ratio, but this in turn requires the use of a round-to-square guide transition at each end. However, a relaxation of the manufacturing tolerances is thereby obtained. The axial ratios of the pin polarizers can be further improved by incorporating cavity compensators in the plane orthogonal to the reactance plane. The phase shift/frequency characteristics of the compensator is opposite to that of the pin polarizer; when combined, a frequency invariant phase shift is obtained.

Figure 4:
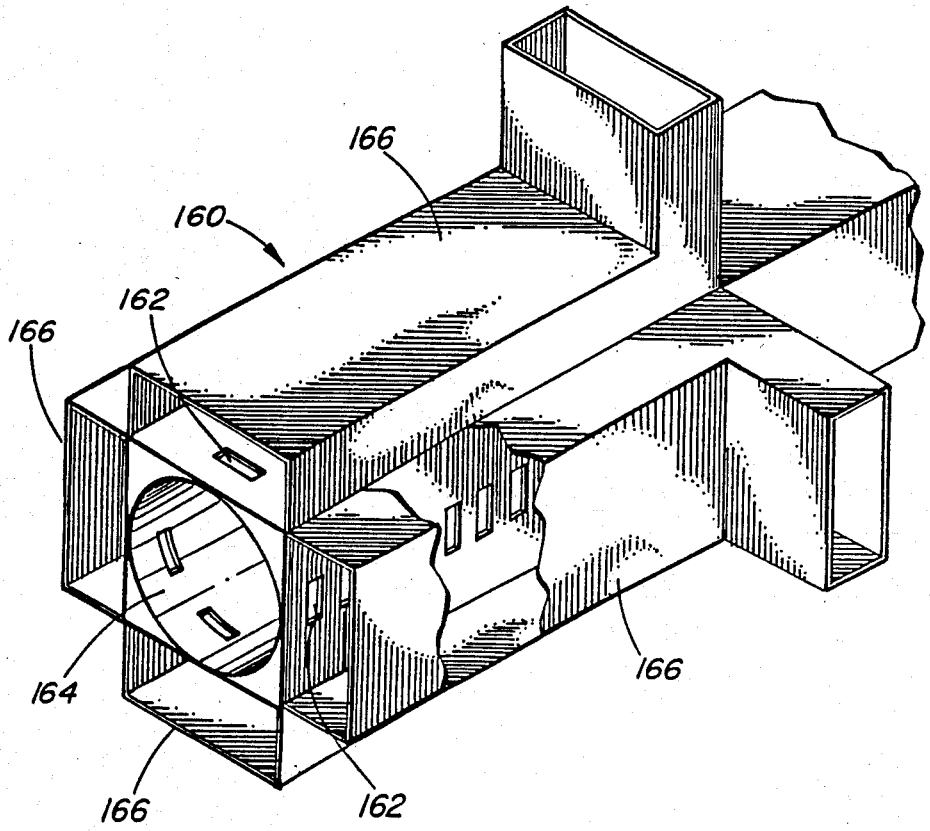
FIG. 4 depicts a partly cut-away view of a $TM_{11}$ mode filter of FIG. 1.

A square-to-round waveguide transition (not shown) connects end 17 of waveguide 15 to a conical corrugated horn 170. Because of the number of junctions the 11 GHz band signal has to pass through, some higher-order modes are inevitably generated. The most troublesome one is the $TM_{11}$ mode, as it degrades the cross-polarization isolation performance of the feed system; as such, this mode must be suppressed before the signal enters into a corrugated horn 170. A $TM_{11}$ mode filter 160 at the 11 GHz band, depicted in FIG. 4, is used for this purpose. Filter 160 consists of four rows of circumferential slots 162 (two rows of which are depicted) cut around the periphery of a main circular guide 164. Circumferential slots 162 couple into four auxiliarly rectangular waveguides 166, through the broadwall of guide 164. The design of filter 160 is based on the requirement that a variation in the propogation constant of the fundamental mode in the auxiliary wave guides 166 must be the same as that of the $TM_{11}$ mode in circular waveguide 164 at the frequency band of coupling. Thus, both waveguides 164 and 166 must be appropriately sized and reactively loaded to meet this wavelength variation condition. The coupling process in the Ku-band region does not, of course, perturb the 4 and 7 GHz bands.

Figure 5:
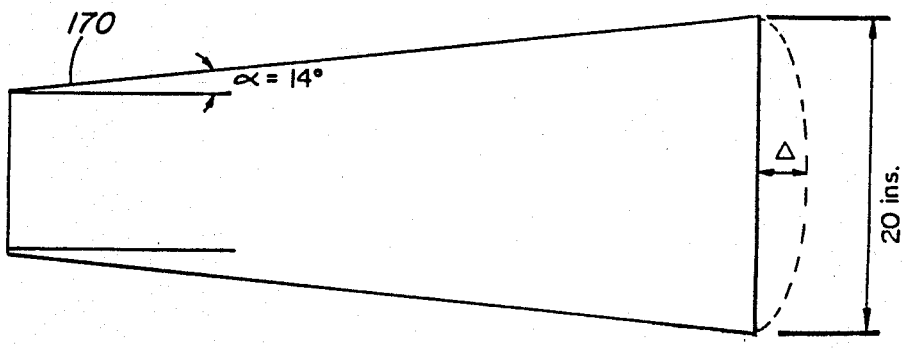
FIG. 5 depicts a flared corrugated horn for an antenna having the feed system of the present invention.

To provide a radiation pattern with low cross-polarization content for illuminating a Cassegrain reflector antenna, of the kind typically used in satellite communication applications, conical corrugated horn 170, shown generally in FIG. 5, is used because of its symmetrical beam and low sidelobe characteristics. The aperture and flare of horn 170 are determined by the requirements of high reflector aperture efficiency and low secondary sidelobes at all three bands. As the frequency of the signal increases, the primary radiation pattern becomes narrower, leading to a drop in aperture efficiency, especially at the Ku-band. To improve the performance of the antenna at the middle and high bands, a flared horn in a beamwidth saturation mode is used to equalize the radiation patterns. This saturation condition is reached when the difference in wavelengths between the spherical wavefront and the plane aperture, given by $\Delta$ in FIG. 5, is greater than 0.75. Under this condition, the pattern phase centres for all three frequency bands have moved back to the throat of the horn, becoming closer together. At the same time, the patterns themselves are equalized. When such a horn is used to illuminate a dual-reflector system, the close proximity of the horn phase centres leads to minimal phase error across the reflector aperture while the nearly equalized patterns result in similar amplitude aperture tapers at all bands. The former increases the antenna efficiency while the latter ensures high efficiencies at all three bands. For the application at hand, a horn with a semi-flare angle $\alpha=14°$ and an aperture diameter of 20 ins is best.

Figure 6:
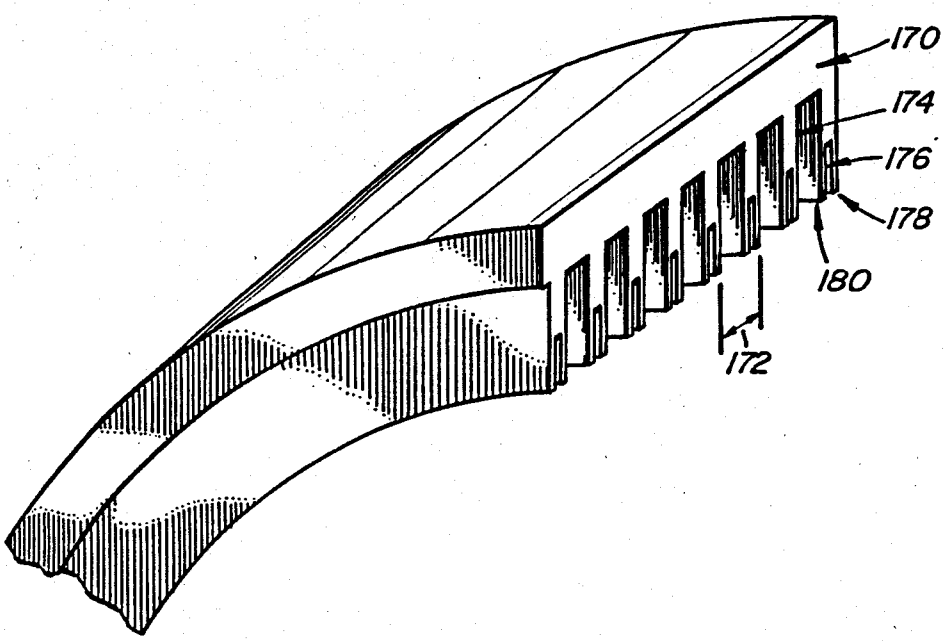
FIG. 6 depicts a detail of a cut-away view of the corrugated horn of FIG. 5.

From antenna theory, it is known that the wall admittance of the feed must be capacitive in order to support the desired fast hybrid mode $HE_{11}$. This condition is met, for a corrugated horn having dual-depth corrugations, when the depth of corrugations is between one-half and one-quarter of the wavelength of the radiated signal; the same capacitive surface admittance condition is also obtained for corrugations having a depth of between three-quarters and one wavelength. In horn 170, a pitch 172 is formed by two teeth 178 and 180, and two slots 174 and 176. Slot 174 is selected to be one-quarter of a wavelength deep at 3.35 GHz or three-quarters of a wavelength at 10.05 GHz; another slot 176 is chosen as a quarter of a wavelength at 7.0 GHz. A detail of pitch 172 and slots 174 and 176 is seen in FIG. 6. With the above selection of slot depths, the surface admittance of combined slots 174 and 176 remains capacitive over the three frequency bands, thereby ensuring low cross-polarization performance of the radiation patterns.

The foregoing has shown and described a particular embodiment of the invention, and variations thereof will be obvious to one skilled in the art. Accordingly, the embodiment is to be taken as illustrative rather than limitative, and the true scope of the invention is as set out in the appended claims.

The embodiments of the invention in which an exclusive property or privilege is claimed are defined as follows:

1. An antenna source system for receiving microwave signals in at least a first lower frequency band and a second higher frequency band, comprising:

a waveguide dimensioned to simultaneously propagate signals in said first and said second frequency bands to a first orthomode junction, and having a stopband characteristic for signals in said first lower frequency band and a passband characteristic for passing signals in said second higher frequency band past said first orthomode junction;

said first orthomode junction coupling signals in said first frequency band in and out of said waveguide and having a first input access coupled to said waveguide through a single slot and five second output accesses;

first filter means coupled to four of said five second output accesses of said first orthomode junction, and having a stopband characteristic for signals in said second higher frequency band and a passband characteristic for signals in said first lower frequency band;

a second orthomode junction having four first input accesses coupled to said first filter means and two second output accesses;

a first and second orthomode transducer each having a first access for receiving signals in one of said frequency bands and a second access, said first orthomode transducer and said second orthomode transducer being respectively coupled between the other of said five second accesses of said first orthomode junction which constitutes a part of said waveguide and between said two second accesses of said second orthomode junction;

a first 90° polarizing device and a first 180° polarizing device coupled in series between said first access and said second access of said first orthomode transducer and said other of said five second accesses of said first orthomode junction;

a second 90° polarizing device and a second 180° polarizing device coupled in series between said first access and said second access of said second orthomode transducer and said two second accesses of said second orthomode junction; and a radiating element connected to an end of said waveguide.

2. The antenna system of claim 1, further comprising:

a third orthomode junction for coupling signals in a third frequency band, said third frequency band being between said first lower frequency band and said second higher frequency band, said third orthomode junction being located at said part of said waveguide constituting said other of said five second accesses of said first orthomode junction and at which said waveguide has a stopband characteristic for signals in said third frequency band and a passband characteristic for passing signals in said second higher frequency band past said third orthomode junction;

said third orthomode junction coupling signals in said third frequency band in and out of said waveguide and having a first input access coupled to said part of said waveguide through a single slot and five second output accesses;

second filter means coupled to four of said second output accesses of said third orthomode junction and having a stopband characteristic for signals in said second frequency band and a passband characteristic for signals in said third frequency band;

a fourth orthomode junction having four first input accesses coupled to said second filter means and two second output accesses;

a third orthomode transducer having a first access for receiving signals in said third frequency band and two second input accesses which are coupled to receive outputs from said two second output accesses of said fourth orthomode junction;

a third 90° polarizing device and a third 180° polarizing device coupled in series between said third orthomode transducer and said fourth orthomode junction.

3. The antenna system of claim 1, wherein said first orthomode junction comprises a pair of side-arm waveguide means.

4. The antenna system of claim 1, wherein said first orthomode junction comprises two pairs of side-arm waveguide means.

5. The antenna system of claim 1, wherein said second orthomode junction comprises a pair of side-arm waveguide means.

6. The antenna system of claim 1, wherein said second orthomode junction comprises two pairs of side-arm waveguide means.

7. The antenna system of claim 2, wherein said waveguide comprises a tapered square manifold between said first orthomode junction and said third orthomode junction and a circular manifold between said third orthomode junction and said third 90° polarizing device.

8. The antenna system of claim 1, wherein said first filter means comprises a corrugated waveguide filter.

9. The antenna system of claim 1, wherein said first filter means comprises a pair of resonant dipole elements.

10. The antenna system of claim 1, further comprising a mode filter between said radiating element and said first orthomode junction.

11. The antenna system of claim 1, wherein said radiating element is a conical corrugated horn.

12. The antenna system of claim 11, wherein said corrugated horn has formed a moderate flare along the length thereof.

13. The antenna system of claim 11, wherein said corrugated horn has two kinds of spaced alternate corrugations, each of said kinds of corrugations having a different depth.

* * * * *